US007272874B2

(12) United States Patent
Staab

(10) Patent No.: US 7,272,874 B2
(45) Date of Patent: Sep. 25, 2007

(54) CREMATION URN CONVERTIBLE INTO A BIRDHOUSE

(75) Inventor: Jeffrey Thomas Staab, Arlington, VT (US)

(73) Assignee: Cremation Solutions LLC, Arlington, VT (US)

( * ) Notice: Subject to any disclaimer, the term of this patent is extended or adjusted under 35 U.S.C. 154(b) by 415 days.

(21) Appl. No.: 11/050,132

(22) Filed: Feb. 3, 2005

(65) Prior Publication Data

US 2006/0168786 A1 Aug. 3, 2006

(51) Int. Cl.
*A61G 17/00* (2006.01)

(52) U.S. Cl. ..... 27/1; 119/430

(58) Field of Classification Search ..... 27/1; D99/5; 119/428–430; D30/124–128
See application file for complete search history.

(56) References Cited

U.S. PATENT DOCUMENTS

| | | | | | |
|---|---|---|---|---|---|
| 388,385 | A | | 8/1888 | Wooster | |
| 1,258,703 | A | | 3/1918 | Perkins | |
| 1,894,406 | A | | 1/1933 | Lenhart | |
| 2,077,208 | A | * | 4/1937 | Brady | 119/430 |
| 2,260,018 | A | | 4/1941 | Garthus | |
| 2,417,178 | A | * | 3/1947 | Ritter | 119/430 |
| D164,446 | S | | 9/1951 | Poglein | |
| 3,115,865 | A | | 12/1963 | Parkes et al. | |
| 3,198,172 | A | * | 8/1965 | Crane, Jr. | 119/430 |
| 3,244,148 | A | | 4/1966 | Long | |
| 3,730,139 | A | | 5/1973 | Moore | |
| 3,783,831 | A | | 1/1974 | Patliff | |
| 4,239,021 | A | * | 12/1980 | Moore | 119/430 |
| D272,577 | S | * | 2/1984 | Dercks et al. | D99/5 |
| 5,029,373 | A | | 7/1991 | Raymond | |
| 5,881,675 | A | * | 3/1999 | Shaffer | 119/430 |
| 6,175,995 | B1 | | 1/2001 | Parker et al. | |
| D444,933 | S | | 7/2001 | Parker | |
| 6,295,705 | B1 | * | 10/2001 | Gersten | 27/1 |
| 6,854,165 | B1 | * | 2/2005 | Parker | 27/1 |
| 6,944,921 | B1 | * | 9/2005 | Gersten | 27/1 |
| 7,043,803 | B2 | * | 5/2006 | Chen | 27/1 |

OTHER PUBLICATIONS

"OPTIONS By Batesville," 2003 Spring/Summer Catalog, pp. 12, 20-30 and 33-36.
Sculptural Gardens Ringed Tube Feeders, Model 7745 and 7746 product brochures, date unknown.

* cited by examiner

*Primary Examiner*—William L. Miller
(74) *Attorney, Agent, or Firm*—Hoffmann & Baron, LLP

(57) ABSTRACT

A cremation container convertible into a birdhouse includes an inner chamber for at least temporarily storing cremation ashes therein, an end face having a first opening in communication with the inner chamber, a peripheral side surface extending from the end face and having a second opening in communication with the inner chamber and a plug fitted in the second opening, which is removable upon conversion of the cremation container into a birdhouse. The first opening is sized for insertion and removal of the cremation ashes in the inner chamber and the second opening is sized to permit entry of a bird into the inner chamber. The container further includes mounting structure for mounting a birdhouse roof to the container.

29 Claims, 14 Drawing Sheets

CREMATION URN CONVERTIBLE INTO A BIRDHOUSE

FIELD OF THE INVENTION

The present invention relates generally to funeral products, and more particularly, to cremation containers for memorializing one whose cremated remains are contained therein or were at one time contained therein.

BACKGROUND OF THE RELATED ART

Up on the death of a loved one, it is often desired to memorialize the deceased's life in some personal manner. When making funeral arrangements, families typically have many options for services and memorials. In making such arrangements, it is generally desired to create a farewell event that is meaningful for those who will participate and to establish a permanent memorial.

Cremation has become a growing segment of the funeral industry. Upon cremation, a deceased's remains are typically contained, at least temporarily, in some form of cremation container. Some desire to have the deceased's ashes scattered from a scattering container, while others choose to store the ashes in a suitable permanent container, such as an urn that may be displayed in the home or in another personal setting. Even where the deceased ashes are scattered, it is often desired to retain and display the scattering container, for example, on a fireplace mantel, coffee table, end table or the like, as a means for memorializing a loved one.

Accordingly, there is a demand for more and higher quality styles and designs of cremation containers. One popular design theme for cremation urns is the outdoor or animal theme, considering that one of the most common places for scattering ashes is the backyard or garden. In this regard, there have been proposed various attractive means for displaying cremation containers.

For example, U.S. Pat. No. 5,029,373 to Raymond discloses a cremation container in the form of a flower vase. The container has a first compartment for storing the ashes of a deceased and a separate second compartment for holding and displaying flowers.

U.S. Pat. No. 6,175,995 to Parker et al. and U.S. Pat. No. D444,933 to Parker show various cremation containers in the forms of lawn and garden ornaments. Specifically, these patents show decorative structures such as sun dials, planters, wind chimes and bird baths that all have an inner compartment for maintaining and securing the ashes of a deceased in a permanent manner.

However, it has been heretofore unknown to provide a cremation container in the form of a birdhouse or birdfeeder and, more particularly, to provide a cremation container that can be easily and simply converted into a birdhouse or birdfeeder.

Accordingly, it would be desirable to provide such an alternative means of memorializing a loved one who has been cremated, as an alternative to the conventional types of cremation containers presently available.

SUMMARY OF THE INVENTION

The present invention is a cremation container that is convertible into a birdhouse or a birdfeeder. The container generally includes an inner chamber for at least temporarily storing cremation ashes therein, an end face having a first opening in communication with the inner chamber, a peripheral side surface extending from the end face and having a second opening in communication with the inner chamber and a closure, such as a plug, fitted in the second opening, which is removable upon conversion of the cremation container into a birdhouse. The first opening is sized for insertion and removal of the cremation ashes in the inner chamber and the second opening is sized to permit entry of a bird into the inner chamber. The container further includes mounting structure for mounting a birdhouse roof on the container.

In a preferred embodiment, the container further includes a surface having a name inscribed thereon, a door on the end face for opening and closing the first opening and a bottom face opposite the end face having mounting structure for mounting the container to a pole. The door may be a sliding door having a magnetic latch for securing the door in a closed position. Also, the container may also include a sealable inner container disposed in the inner chamber for permanently storing cremation ashes therein.

The present invention may take the form of a kit for converting a cremation urn into a birdhouse or a birdfeeder. The kit generally includes a container in the form of a cremation urn as described above and a roof structure for removable attachment to the container for covering the first opening upon conversion of the container into a birdhouse. Again, the kit further includes a closure, such as a plug, which is removable from the second opening of the container upon conversion of the container into a birdhouse. The roof structure may include a rim that is sized to be friction fit on the container.

The present invention further involves a method for memorializing a loved one who has been cremated. The method generally includes the steps of storing the loved one's cremated ashes in a container at least temporarily, converting the container into a birdhouse and displaying the birdhouse in a manner wherein the loved one will be remembered upon viewing the birdhouse. Preferably, the loved one's name is inscribed on the container. The loved one's cremation ashes may be scattered from the container prior to converting the container into the birdhouse or the loved one's cremation ashes may be permanently stored in the birdhouse, wherein a sealable container for storing the cremation ashes is placed in an inner chamber of the cremation container.

In converting the cremation container into a birdhouse, the method according to the present invention generally includes the steps of attaching a roof structure to a top surface of the cremation container to cover an inner chamber of the cremation container used to at least temporarily store cremation ashes and removing a plug from the cremation container to provide an entrance for a bird into the inner chamber of the cremation container.

In an alternative embodiment, the present invention involves a method for memorializing a loved one who has been cremated comprising the steps of storing the loved one's cremated ashes in a container at least temporarily, converting the container into a birdfeeder and displaying the birdfeeder as a memorial, in such a manner that the loved one will be remembered upon viewing the birdfeeder. In converting the container into a birdfeeder, an inner chamber of the container can be filled with birdseed and a food tray is attached to a bottom surface of the container below the inner chamber.

These and other objects, features, and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
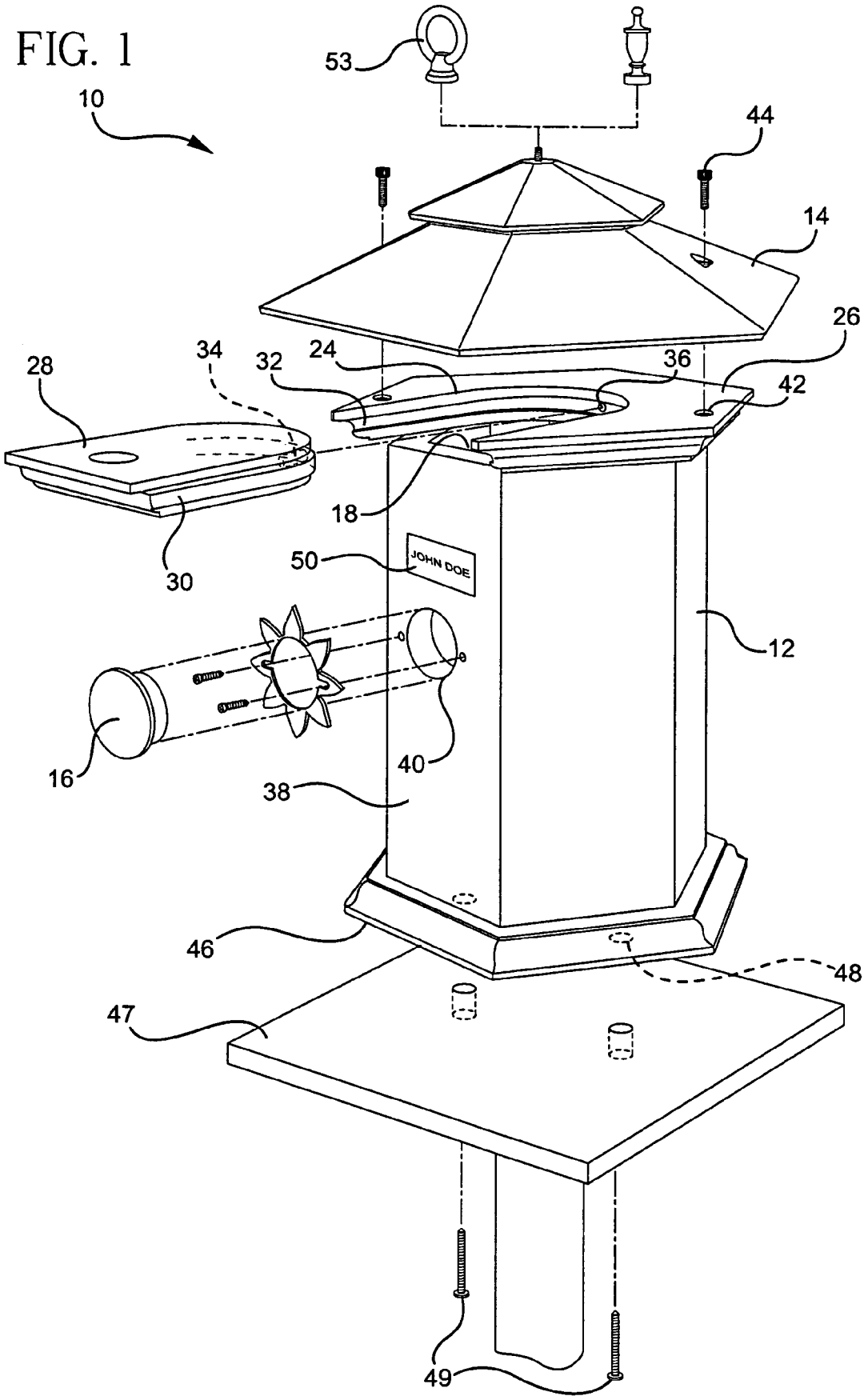
FIG. 1 is an elevated perspective view of an exploded combination cremation container and birdhouse formed in accordance with the present invention.

Referring first to FIGS. 1-10, a combination cremation container/birdhouse 10 generally includes a convertible cremation container 12, a roof structure 14 for removable attachment to the container and a closure 16 also removably attached to the container. The cremation container 12 is generally in the form of a cremation urn known in the art. In particular, the cremation container 12 defines an inner chamber 18 for storing cremated ashes of a deceased therein. The closure 16 preferably takes the form of a plug, which may be friction-fit, press-fit or screwed into an opening 40 of the container. However, the closure 16 may take any other alternative forms, such as a decal or tape, so long as the opening 40 can be adequately sealed closed.

Figure 2:
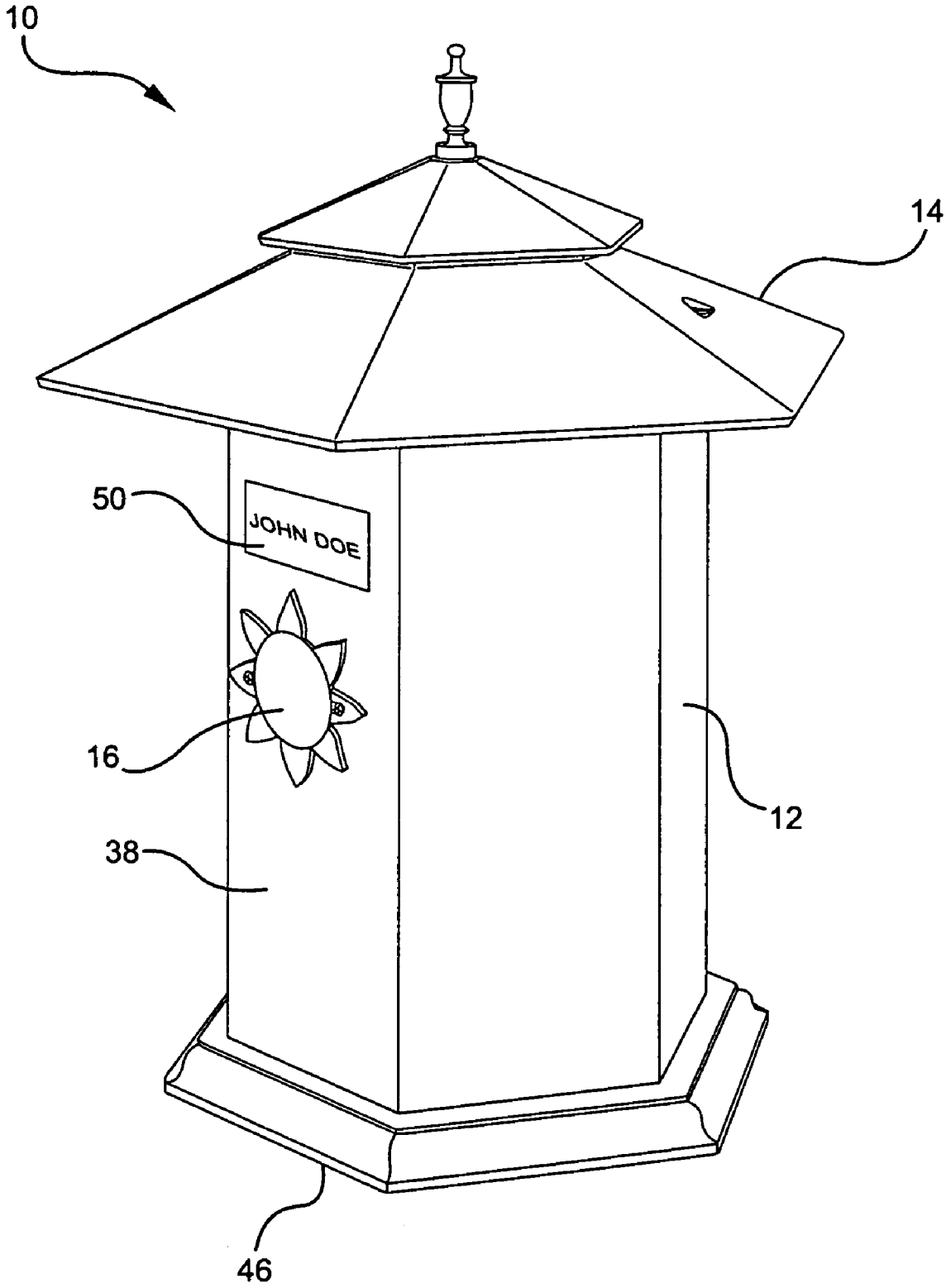
FIG. 2 is an elevated perspective view of the assembled combination cremation container and birdhouse shown in FIG. 1.
Figure 4:
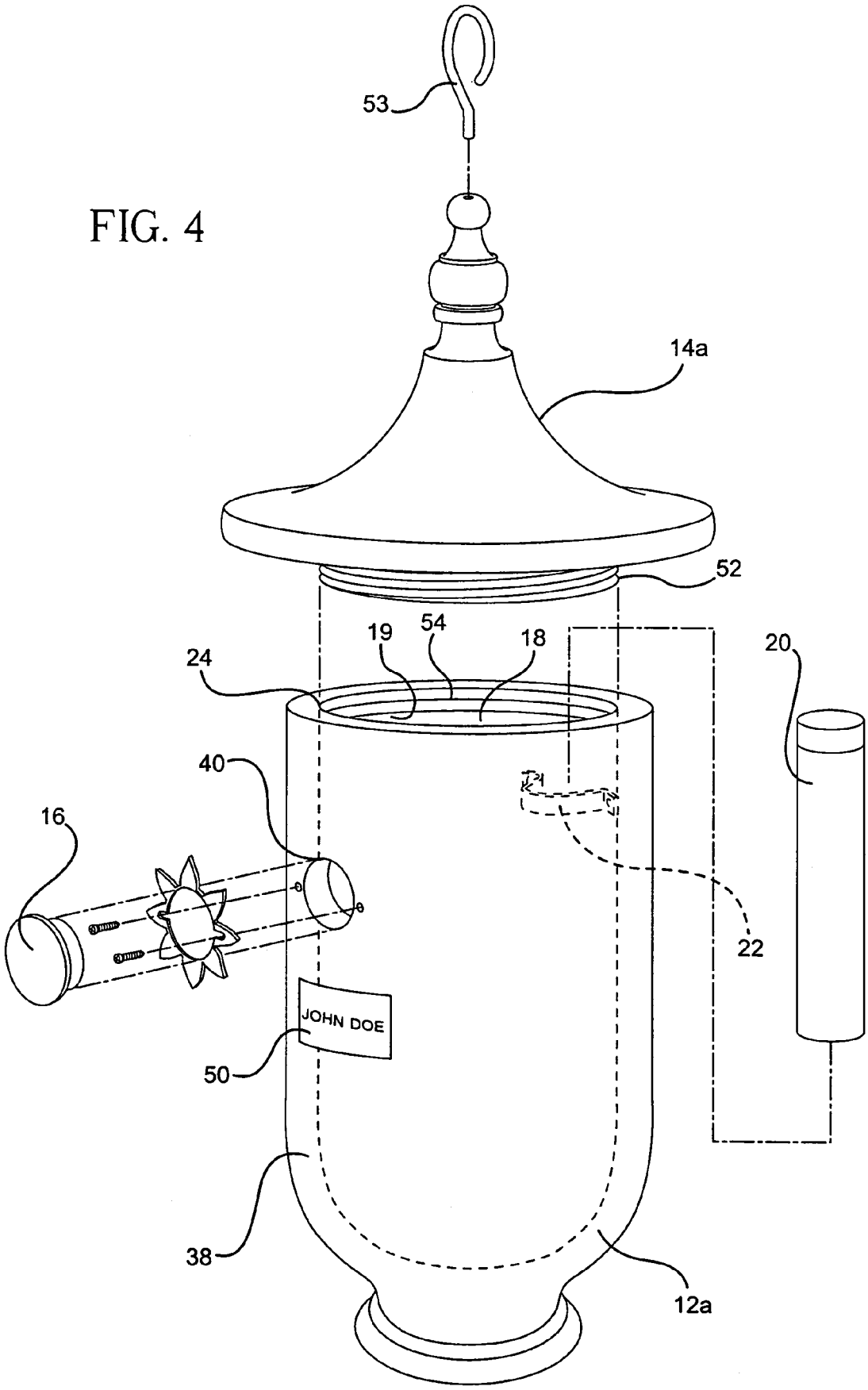
FIG. 4 is an elevated perspective view of an exploded alternative embodiment combination cremation container and birdhouse formed in accordance with the present invention.

The cremation container 12 may function as a scattering urn, wherein the cremated ashes are contained in the inner chamber 18 only temporarily and are at some point scattered from the inner chamber. Alternatively, the container 12 may serve to permanently store a deceased's ashes. In this case, it is preferred to provide a sealable container 20 disposed within the inner chamber 18, as shown in FIG. 4. The sealable container 20 is smaller than the inner chamber 18 and may be in the form of a capped tube, a plastic bag, a box, or in any other form that can safely isolate the ashes from the remainder of the inner chamber 18. Moreover, the sealable container 20 may be retained against an inner wall 19 of the inner chamber 18 by a bracket or clip 22, as shown in FIG. 2, or by any other form of retaining structure. Again, the purpose of the sealable container 20 is to maintain the deceased ashes sealed and apart from the remainder of the interior chamber 18.

The cremation container 12 further includes a first opening 24 communicating with the interior chamber 18. The first opening 24 is sufficiently large enough for easily inserting and removing the deceased's ashes into and out of the interior chamber 18. The first opening 24 is preferably formed in a top end surface 26 of the container 12. Additionally, the first opening 24 is further preferably provided with a door 28 for opening and closing the first opening 24. The door 28 may take any form. However, in a preferred embodiment, the door 28 is a sliding door having a groove and rib structure 30 cooperating with a groove and rib structure 32 provided on the periphery of the first opening 24. Also, the sliding door 28 is further preferably provided with a latch 34 which engages a plate 36 provided on the first opening 24 to maintain the door in a closed position. The latch 34 may take any form, but is preferably a magnetic latch which magnetically engages a metallic plate to maintain the door in a closed position until sufficient force is applied to separate the two.

The container 12 also includes at least one sidewall 38 extending downwardly from the top end surface 26. The sidewall 38 includes a second opening 40 also communicating with the inner chamber 18. The second opening 40 is sized to permit entry of a bird through the opening into the inner chamber 18. The closure, such as a plug 16, is initially secured within the second opening 40 to seal the inner chamber 18 prior to, for example, scattering the ashes from the inner chamber. The plug 16 may be friction fit within the second hole 40 or may be secured in any conventional manner, such as by cooperating threads or detents.

Figure 7:
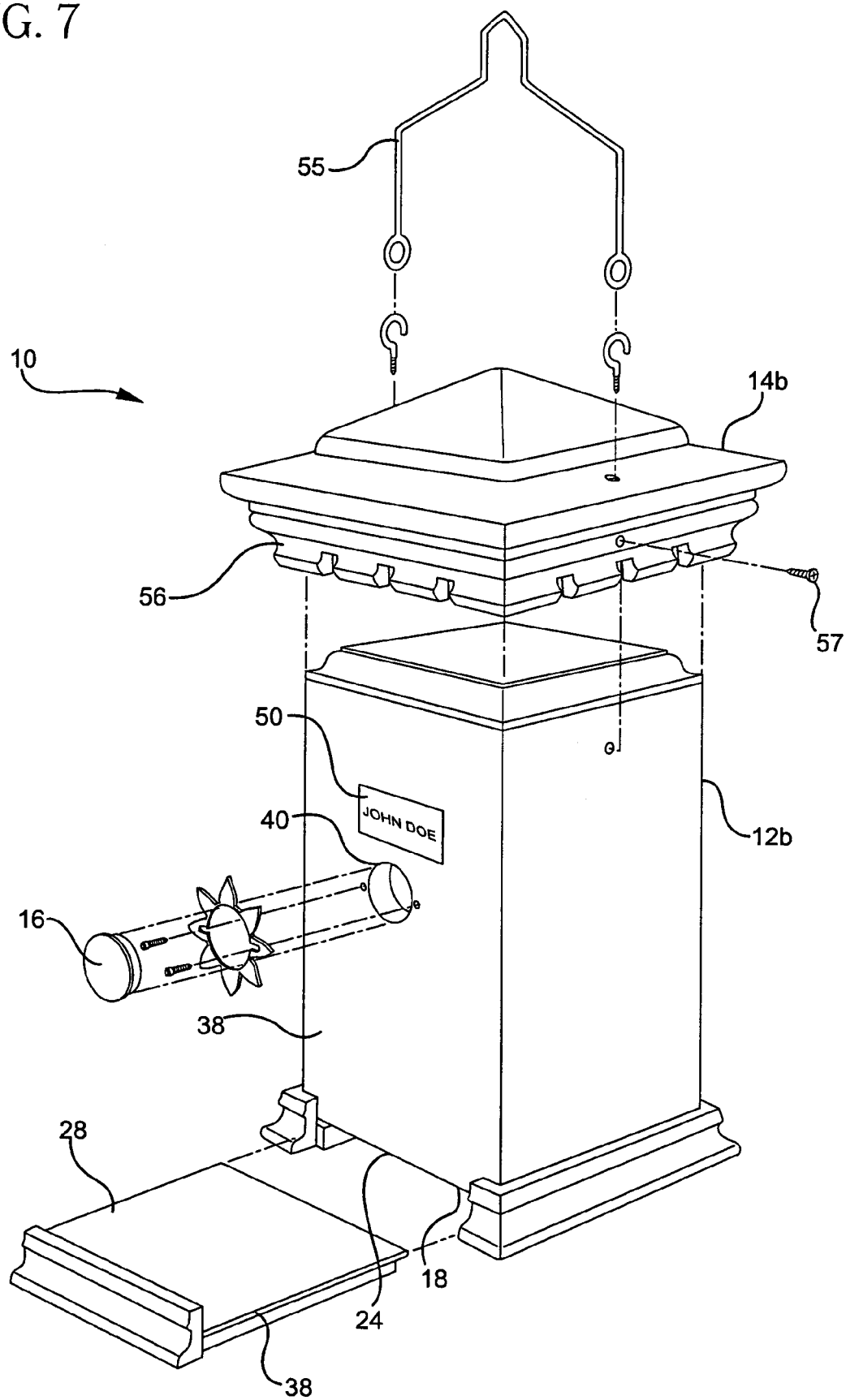
FIG. 7 is an elevated perspective view of another exploded alternative embodiment combination cremation container and birdhouse formed in accordance with the present invention.
Figure 8:
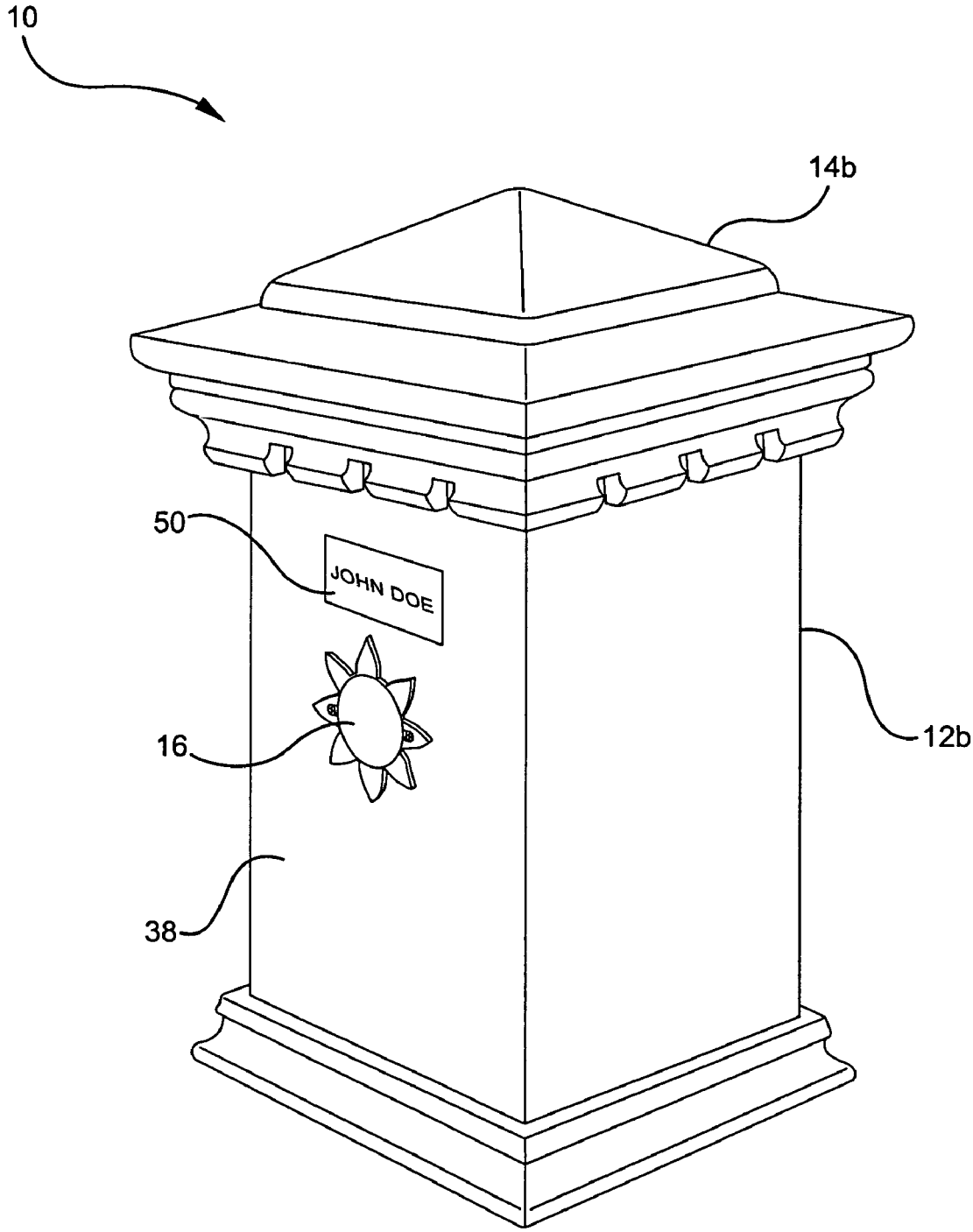
FIG. 8 is an elevated perspective view of the assembled combination cremation container and birdhouse shown in FIG. 7.
Figure 9:
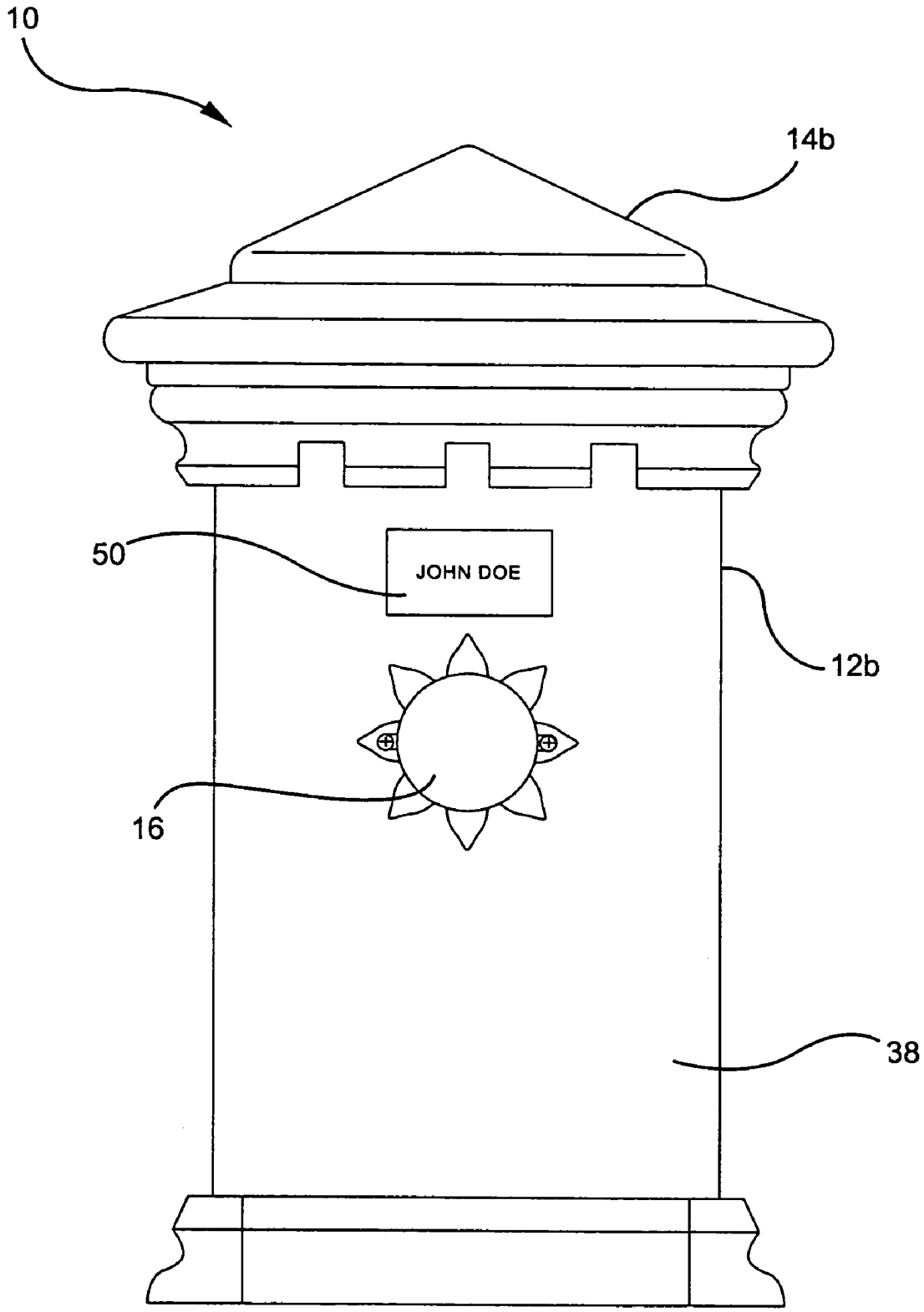
FIG. 9 is a side view of the assembled combination cremation container and birdhouse shown in FIG. 7.
Figure 10:
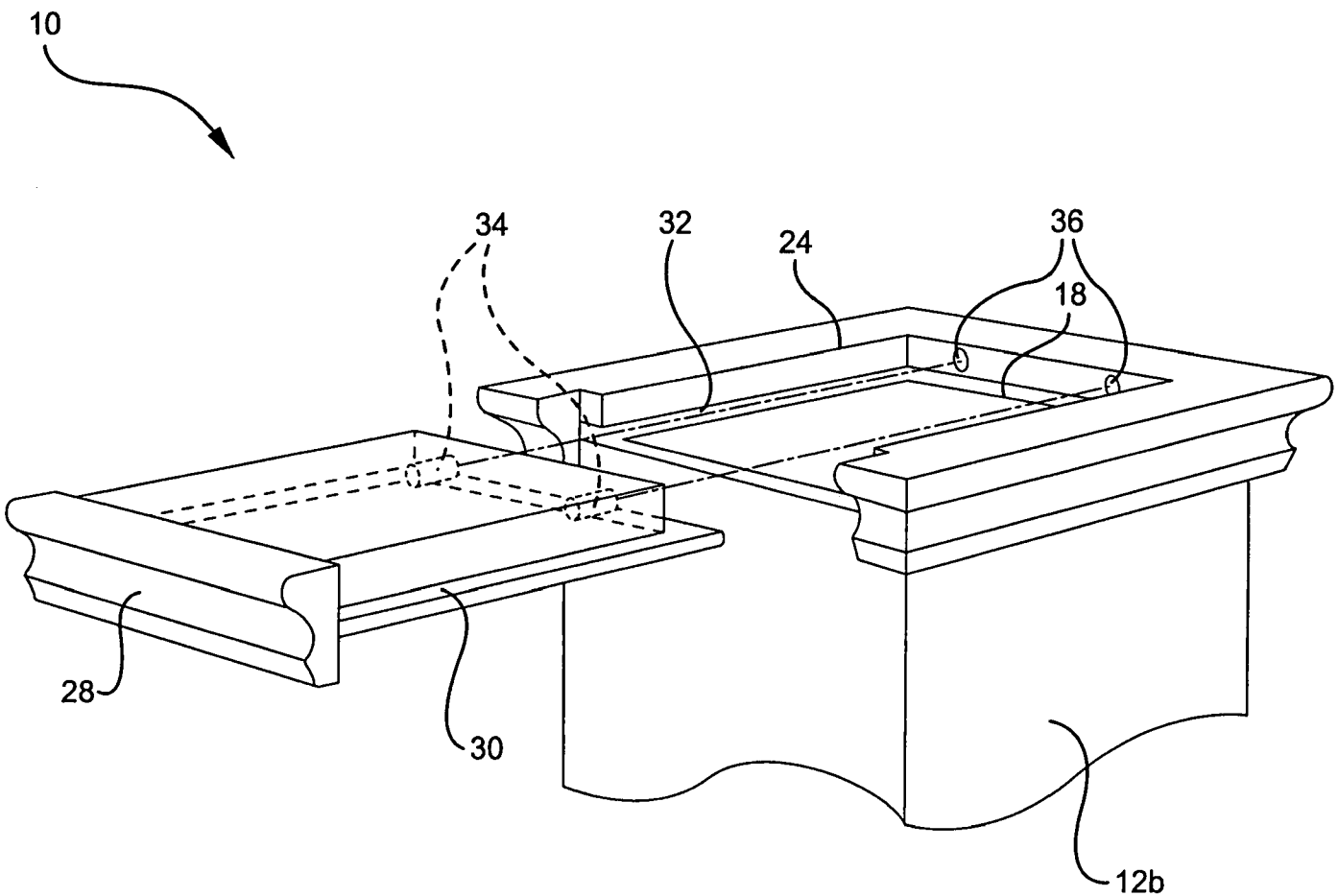
FIG. 10 is a bottom perspective view of the combination cremation container shown in FIG. 7.

The top end surface 26 is further provided with mounting structure for attaching the birdhouse roof structure 14 to the container 12. The mounting structure can take any form. In a preferred embodiment, the mounting structure is in the form of a threaded hole or a threaded insert 42 to receive a screw 44 inserted through the roof structure 14 to hold the roof structure to the container 12. The screws 44 may be in the form of eye-hooks so that, once assembled, the birdhouse 10 can be hung from above. Alternatively, the mounting structure may take the form of a threaded rim 52 provided on the roof structure 14*a*, which cooperates with a mating thread portion 54 provided on the inside wall 19 of the inner chamber 18, as shown in FIG. 2. Also, as shown in FIG. 7, a roof structure 14*b* may be provided with a rim 56 that is sized to be friction fit over the container 12*b*, or the rim may be sized to be friction fit within the first opening 24 of the inner chamber 18. In any event, a set screw 57 may be provided to facilitate fastening of the roof structure to the container, as shown in FIG. 7.

Figure 11:
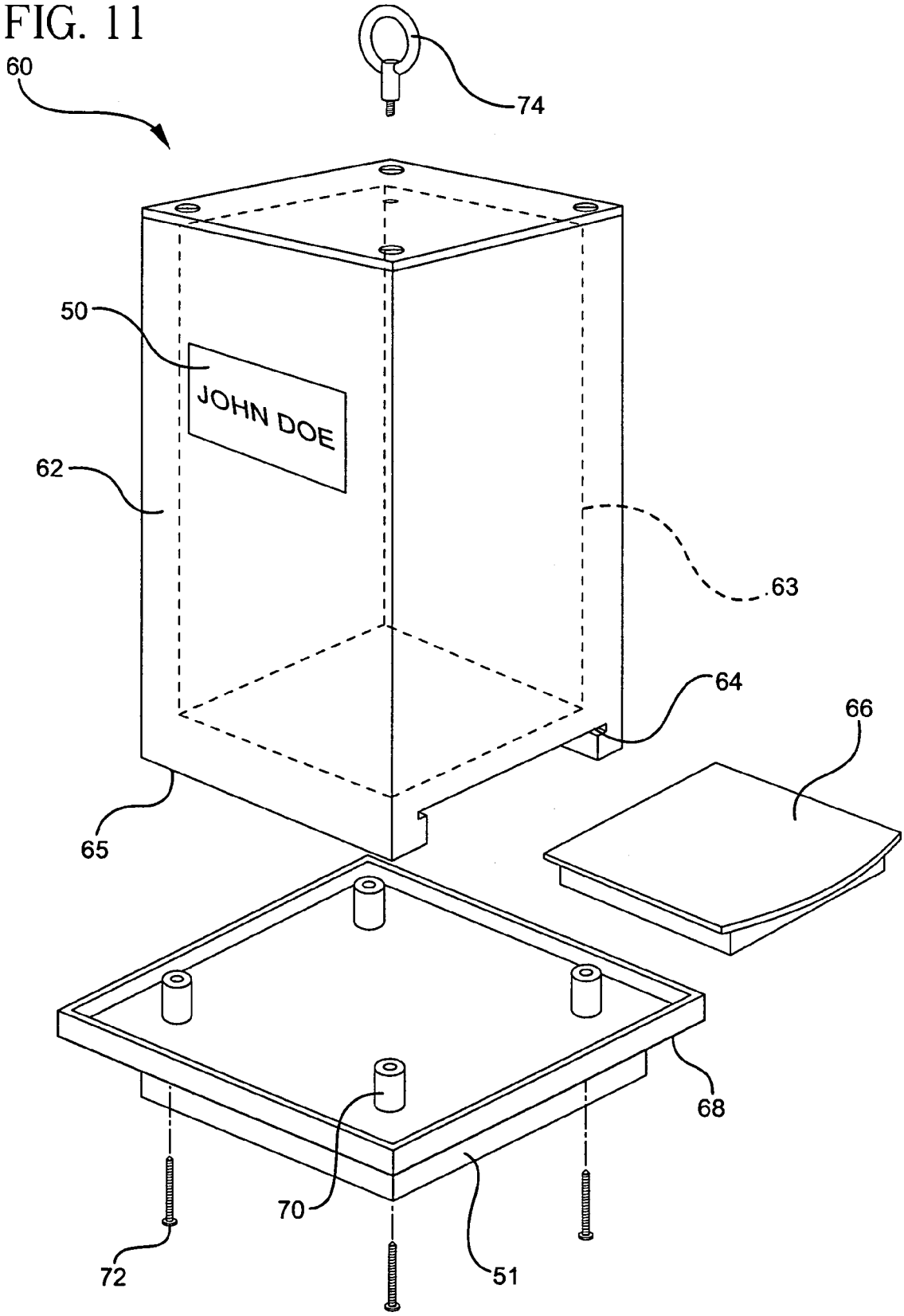
FIG. 11 is a top perspective view of yet another alternative embodiment of the present invention, wherein a cremation container is convertible into a birdfeeder.
Figure 12:
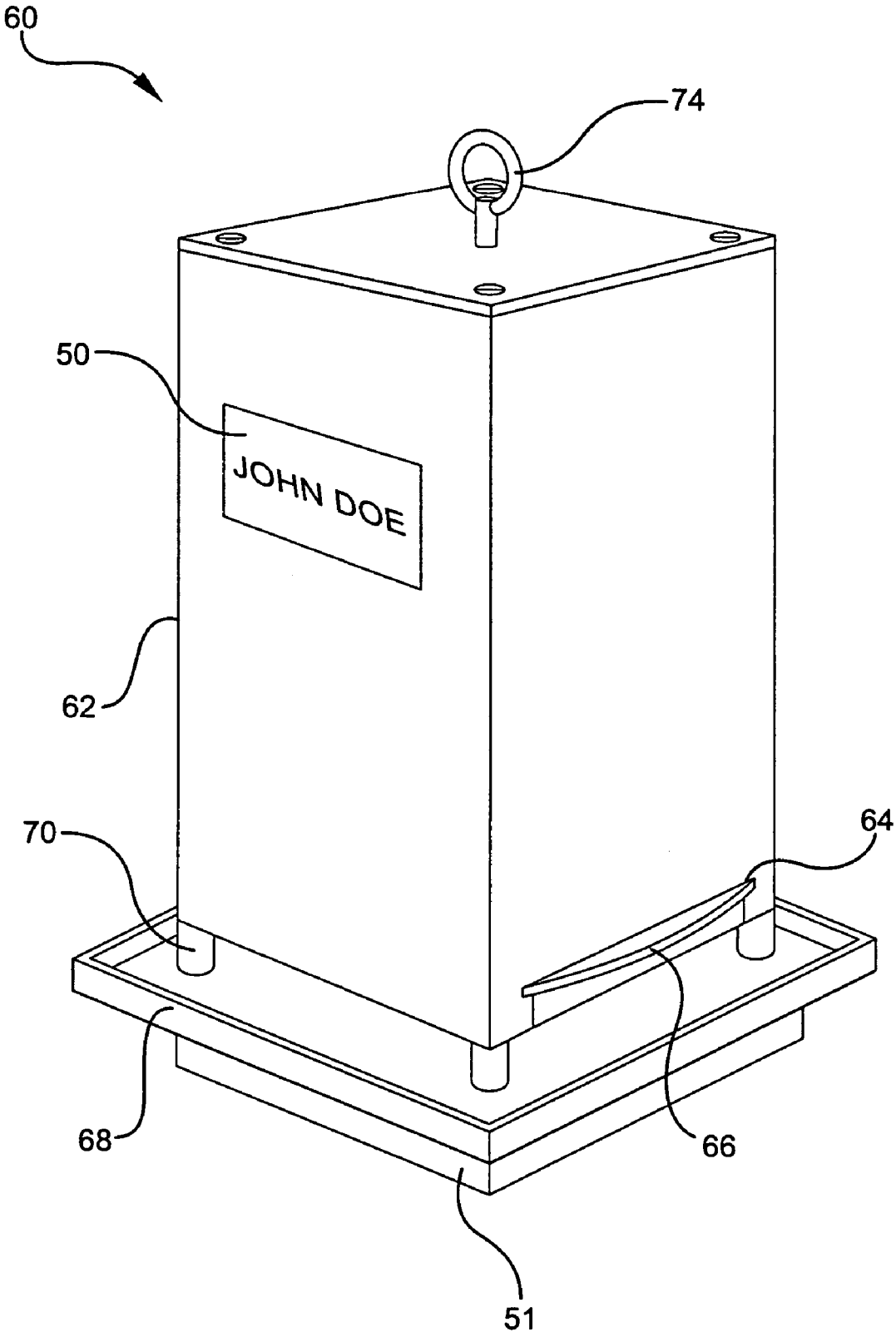
FIG. 12 is a top perspective view of the assembled combination cremation container and birdfeeder shown in FIG. 11.
Figure 13:
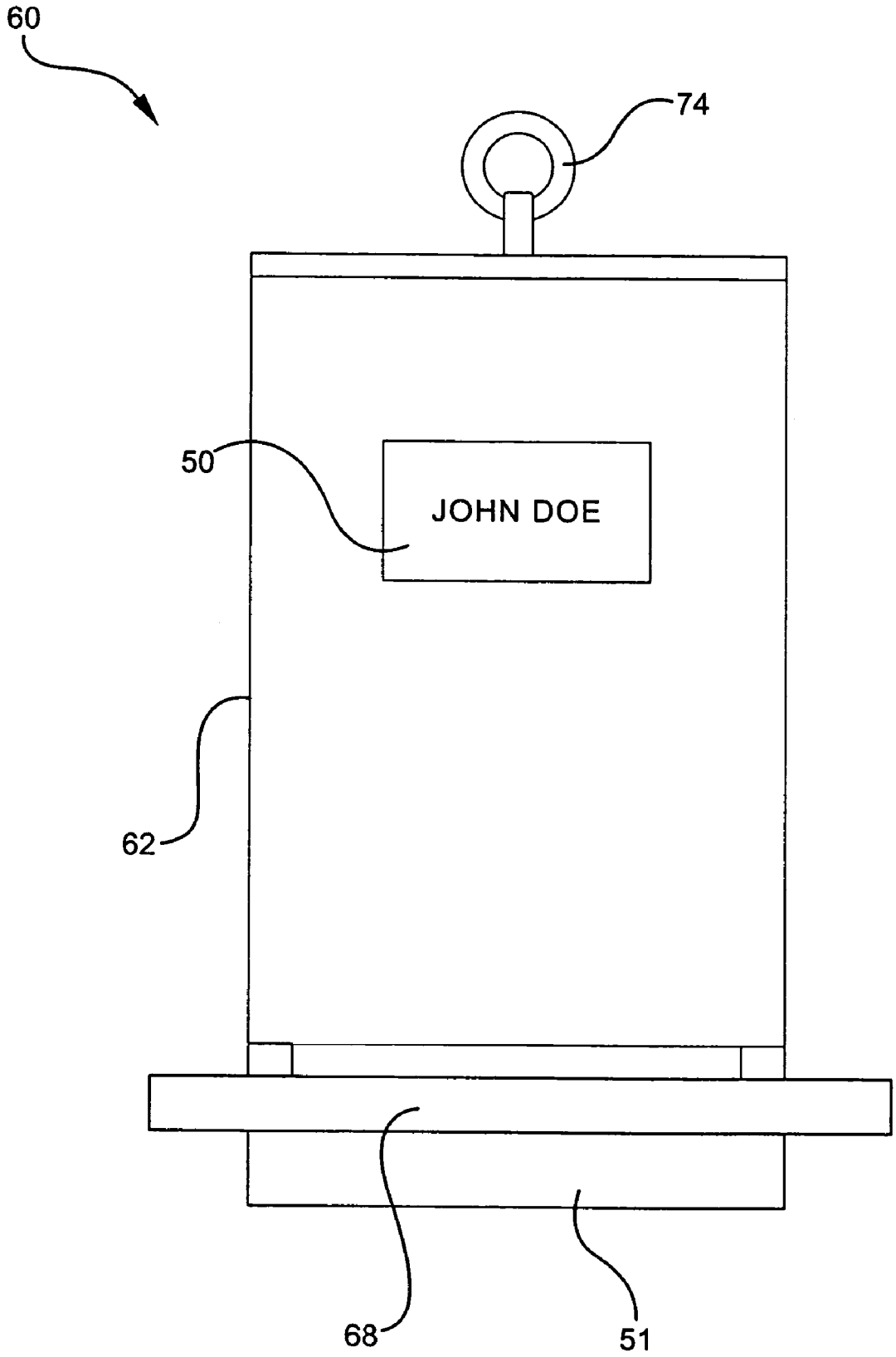
FIG. 13 is a side view of the assembled combination cremation container and birdfeeder shown in FIG. 11.

The container 12 may further include a bottom end surface 46 having mounting structure for mounting the container 12 to a pole 47, for example, as shown in FIG. 1. Again, the mounting structure may take the form of a threaded hole 48 or a through hole for receiving a mounting screw 49 or other fastener to secure the container 12 to the pole 47. Alternatively, the mounting structure may take the form of a post cap 51 sized to slip over and mount to a post, as shown in FIGS. 11-13.

At least one of the surfaces of the container 12 or roof structure 14 preferably includes a placard or plaque 50 defining a surface upon which biographical information concerning the deceased may be inscribed or engraved. Such biographical information may include the deceased's name, date of birth, date of death, surviving family, etc. The purpose of the plaque 50 is to provide a visual remembrance or memorial of the deceased upon viewing the birdhouse 10. It is noted that the terms "deceased" and "loved one," as used herein, may refer not only to persons, but also to pets or other animals.

Figure 3:
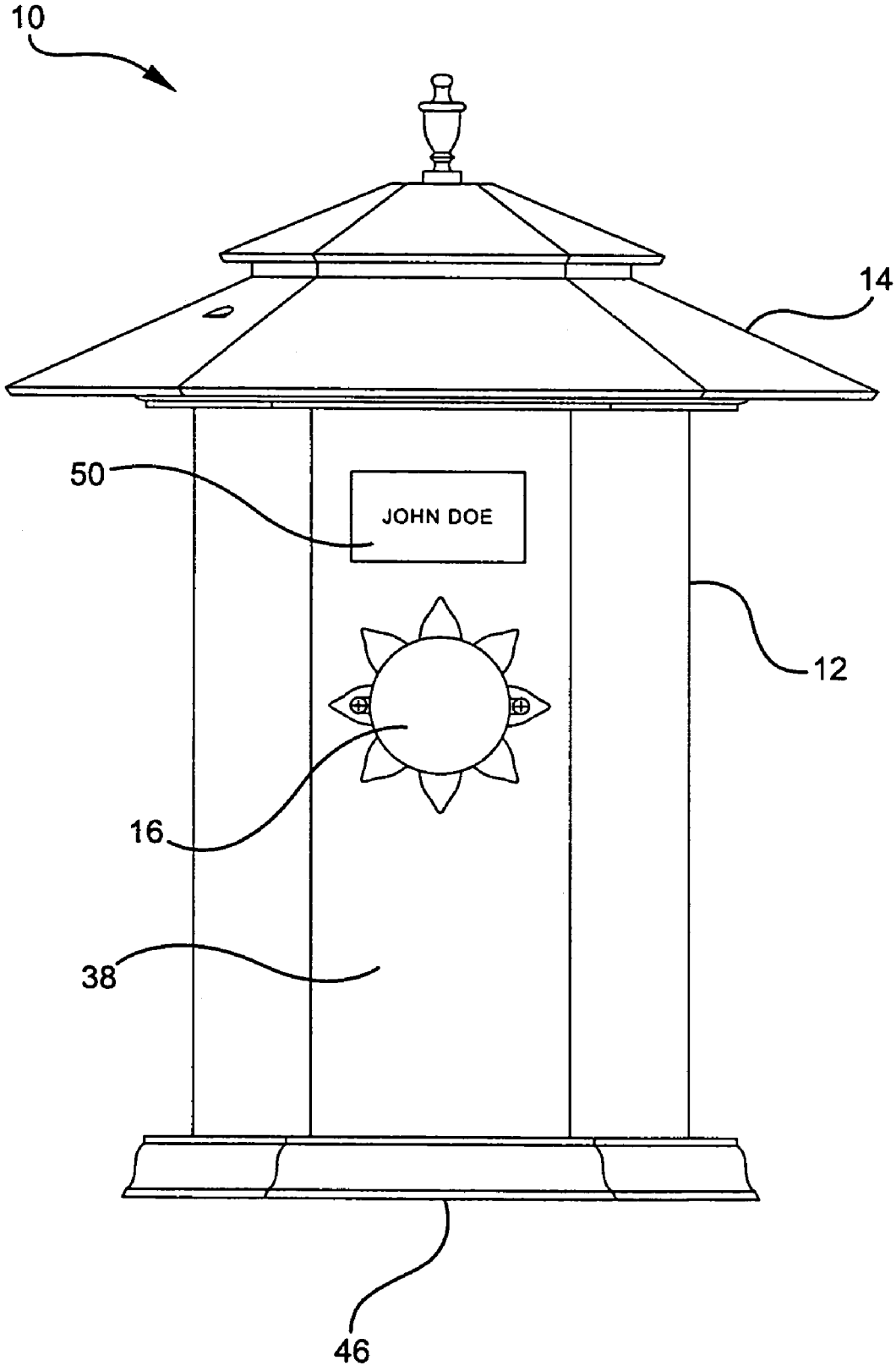
FIG. 3 is a side view of the assembled combination cremation container and birdhouse shown in FIG. 1.
Figure 5:
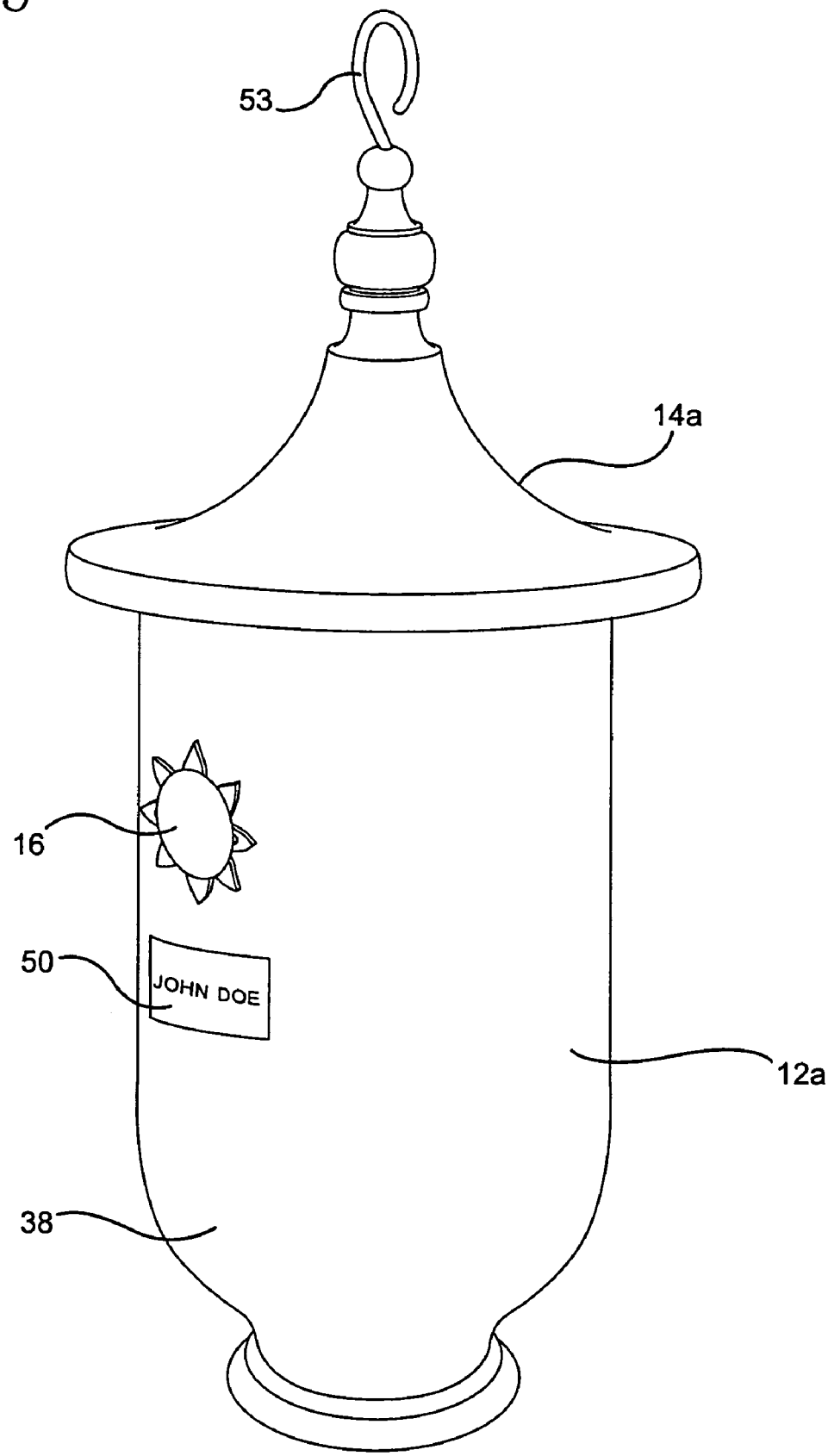
FIG. 5 is an elevated perspective view of the assembled combination cremation container and birdhouse shown in FIG. 4.
Figure 6:
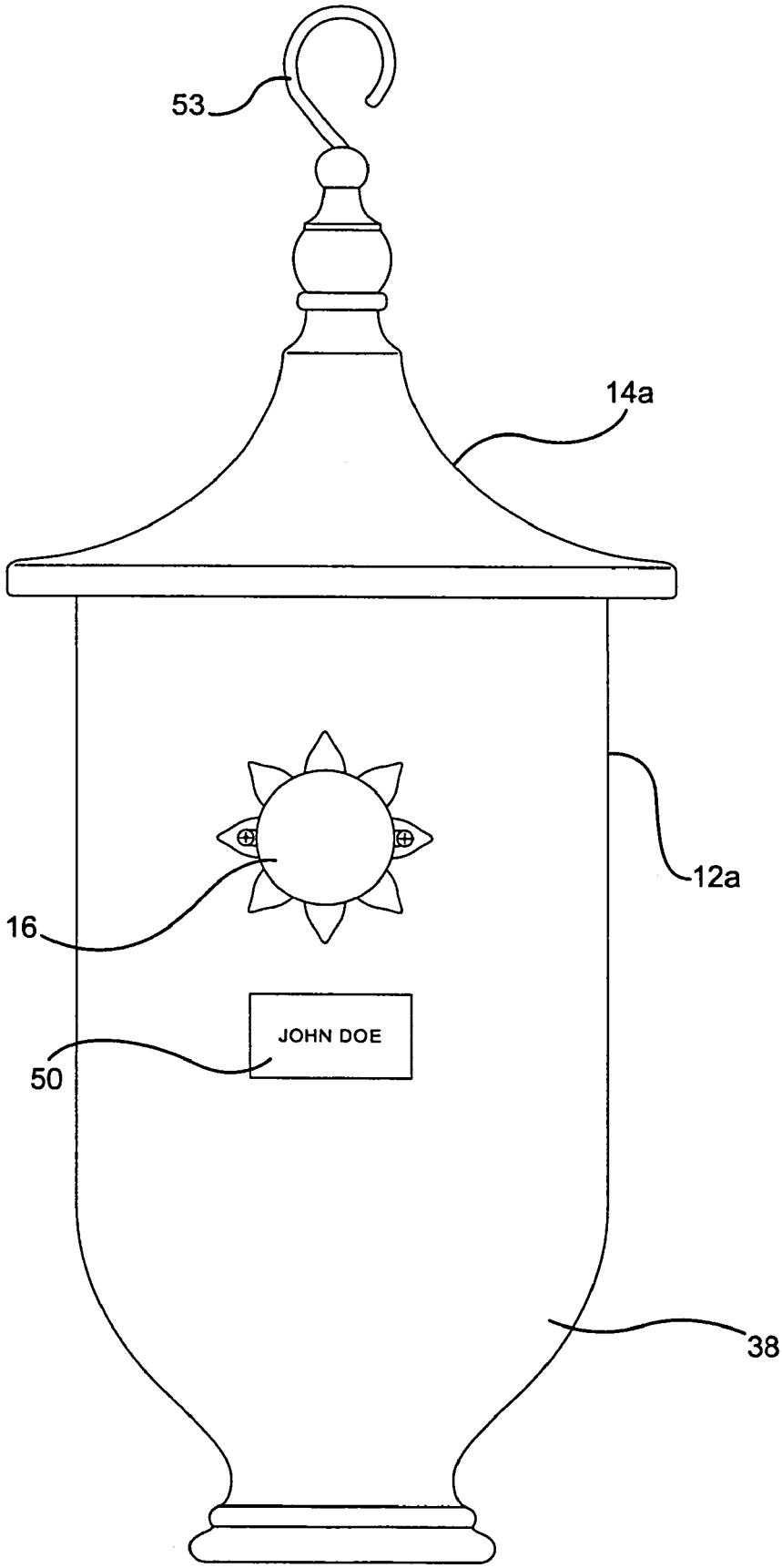
FIG. 6 is a side view of the assembled combination cremation container and birdhouse shown in FIG. 4.

As further shown in FIGS. 1-10, the container 12 and roof structure 14 may take various forms. For example, an octagonal container 12 and roof structure 14 is shown in FIGS. 1-3, a cylindrical container 12*a* and roof structure 14*a* is shown in FIGS. 4-6 and a rectangular container 12*b* and rectangular roof structure 14*b* is shown in FIG. 7-10. Moreover, for the most part, each of the various methods for mounting the roof structure described above may be utilized in each of the above embodiments regardless of shape. Finally, in each embodiment, the container may be hung from above in various ways. For example, an eye hook 53 may be attached to the roof, as shown in FIGS. 1 and 4-6, or a hanging bale 55 may be attached to the roof, as shown in FIG. 7.

It is also noted that in FIGS. 7-10, the first opening 18 communicates with a first opening 24 which faces the bottom of the container 12*b*. Additionally, the sliding door 28 covering the first opening 24 at the bottom of the container 12*b* shown in FIGS. 7-10 includes two magnetic latches 34 engaging two magnetic plates 36 provided on the first opening. Thus, the roof structure may be attached over the first opening, as shown in FIGS. 1-6, or opposite the first opening, as shown in FIGS. 7-10.

In each of the embodiments described above, upon cremation, the deceased's ashes are initially placed in the inner chamber 18 of the container 12, at least temporarily. At this time, the closure 16 is secured in the second opening 40 and the roof structure 14 is usually not yet attached. Also, as mentioned above, if the cremation container 12 is to serve as a cremation urn for permanently storing the deceased's ashes, the ashes are preferably placed in a sealable container 20 which is secured within the inner chamber 18. Once the sealable container 20 is secured within the inner chamber 18, in the case of a permanent cremation urn, or, once the ashes are scattered from the inner chamber, in the case of a scattering urn, the container is now ready to be converted into a birdhouse. To accomplish this, the closure 16 is removed from the second opening 40 and the roof structure 14 is attached to the container 12 in one of the manners described above. The birdhouse 10 can then be hung from a tree or secured to a post and displayed in a manner in which the deceased will be remembered and memorialized.

FIGS. 11-13 show the present invention in the form of a birdfeeder 60. In this embodiment, the cremation container 62 includes an inner chamber 63 for at least temporarily storing a deceased's cremated ashes and a first opening 64 disposed on a bottom surface 65 of the container. Similar to that described above, the first opening 64 is in communication with the inner chamber 63 of the container 62 for inserting and removing the ashes. Additionally, the container 62 may be provided with a door 66 for opening and closing the first opening 64.

However, in this embodiment, a bottom food tray 68 is provided for attachment to the bottom 65 of the cremation container 62. The food tray 68 includes a plurality of spacers 70 which, when attached to the container 62, will space the tray 68 away from the bottom of the container. This will provide a space between the container 62 and the food tray 68 to permit bird food in the container to spill out of the container onto the tray. The tray 68 may be fastened to the bottom of the container 62 in a conventional manner, such as by screws 72 inserted through the spacers 70 into threaded holes in the bottom 65 of the container.

Again, the cremation container 62 can function as a scattering urn, wherein the deceased's ashes are removed from the container and scattered prior to conversation of the container to a birdfeeder. Alternatively, where it is desired to permanently store a deceased's cremated ashes in the container 62, a sealable bag, or tube (not shown in FIGS. 11-13) may be secured to the inner chamber 63 as described above. Thus, after the ashes are scattered from the container 62, or after the sealable container is secured within the inner chamber 63, the container may be filled with bird seed and the food tray 68 may be attached to the bottom surface 65 of the container. The door 66 may then be opened, wherein the bird seed will pour from the container 62 onto the tray 68.

Here too, a roof structure having means for hanging the birdfeeder from above may be attached to the container. Alternatively, an eye-hook 74, for example, may be attached directly to the top of the container 62. Also, the tray 68 may include structure for mounting the birdfeeder to a pole or other structure. Specifically, as mentioned above, the tray 68 may include a post cap portion 51 for mounting the birdfeeder to a post or pole.

Figure 14:
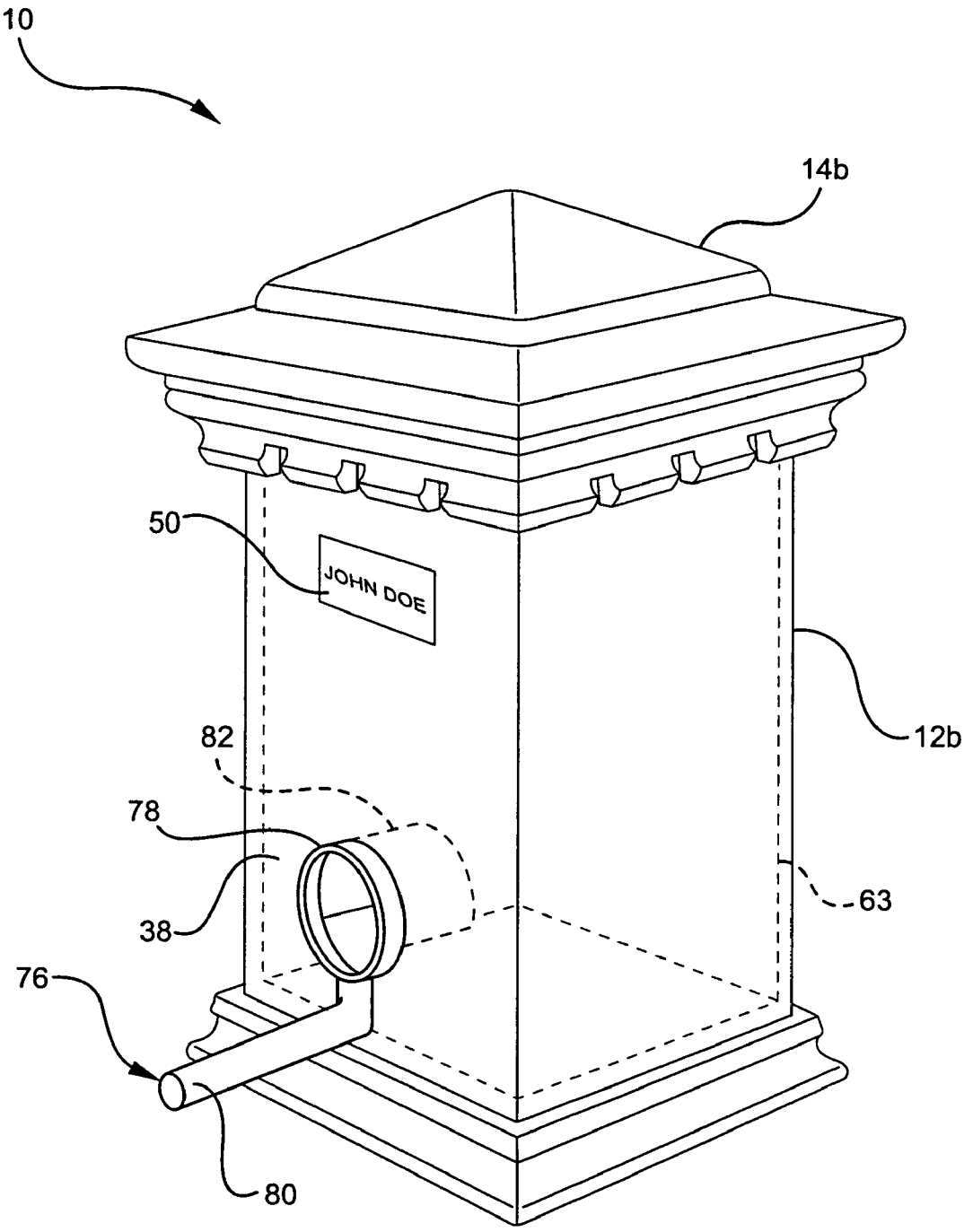
FIG. 14 is a top perspective view of still another alternative embodiment of the present invention in the form of a birdfeeder.

FIG. 14 shows another alternative embodiment of the present invention in the form of a birdfeeder. In this embodiment, a perch structure 76 is mounted to an opening 78 disposed adjacent to the bottom of the container. The opening is in communication with the inner chamber 63 so as to permit bird food within the container to be accessible at the opening. The perch structure 76 includes a perch 80 extending outwardly from the opening 78 to allow a bird to stand thereon. The perch structure 76 further includes a hood portion 82 extending into the interior chamber 63 of the container for preventing the bird food from spilling out of the opening 78.

As described herein, the present invention can be provided as a kit for converting a cremation container into a birdhouse or a birdfeeder. The kit includes the cremation container as described herein, which at least temporarily stores the cremated ashes of a deceased and may include a closure, such as a plug which is removable from the container to convert the container into a birdhouse. The kit further includes a roof structure and/or a food tray which can be attached to the container when converting the container into a birdhouse or a birdfeeder. The kit further preferably includes all of the assembly and mounting hardware required to make the conversion.

The components of the kit are all preferably made from materials that are capable of withstanding the exterior elements, such as wind, rain, sun and snow. In particular, the container, roof, plug and food tray may be made from such materials as treated wood, durable plastics, ceramics, metals and combinations thereof.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A method of memorializing a deceased who has been cremated comprising the steps of:

storing the deceased's cremation ashes in a container at least temporarily;

converting said container into a birdhouse by attaching a roof structure to a top surface of said container to cover an inner chamber of said container used to at least temporarily store said cremation ashes, and removing a closure from said container to provide an entrance for a bird into said inner chamber of said container; and displaying said birdhouse in a manner wherein the deceased will be remembered upon viewing said birdhouse.

2. A method as defined in claim 1, further comprising the step of inscribing biographical information concerning the deceased on said container.

3. A method as defined in claim 1, further comprising the step of scattering the deceased's cremation ashes from said container prior to converting said container into said birdhouse.

4. A kit for converting a cremation urn into a birdhouse comprising:

a container defining said cremation urn having an inner chamber for at least temporarily storing cremation ashes, said container having first and second openings in communication with said inner chamber, said first opening being sized for inserting and removing the cremation ashes in said inner chamber and said second opening being sized to permit entry of a bird into said inner chamber;

a roof structure for removable attachment to said container upon conversion of said container into said birdhouse; and a closure removable from said second opening upon conversion of said container into said birdhouse.

5. A kit as defined in claim 4, wherein said container further includes a surface having biographical information inscribed thereon.

6. A kit as defined in claim 4, wherein said container further includes a door for opening and closing said first opening.

7. A kit as defined in claim 6, wherein said door is a sliding door.

8. A kit as defined in claim 6, wherein said door includes a latch for securing said door in a closed position.

9. A kit as defined in claim 4, wherein said roof structure includes a rim that is sized to be friction fit on said container.

10. A kit as defined in claim 4, wherein said container further includes a bottom surface opposite said first opening, said bottom surface including mounting structure for mounting said container to a pole.

11. A kit as defined in claim 4, further comprising a sealable container disposed in said inner chamber for storing said cremation ashes therein.

12. A cremation container convertible into a birdhouse, said container comprising:

an inner chamber for at least temporarily storing cremation ashes therein;

a first end face having a first opening in communication with said inner chamber, said first opening being sized for insertion and removal of the cremation ashes in said inner chamber;

a second end face opposite said first end face;

mounting structure for mounting a birdhouse roof to the container disposed on one of said first and second end faces;

a peripheral side surface extending between said first and second end faces, said side surface having a second opening in communication with said inner chamber, said second opening being sized to permit entry of a bird into said inner chamber; and a closure removably fitted on said second opening, said closure being removed from said second opening upon conversion of the cremation container into said birdhouse.

13. A cremation container as defined in claim 12, further comprising a surface having biographical information inscribed thereon.

14. A cremation container as defined in claim 12, further comprising a door on said first end face for opening and closing said first opening.

15. A cremation container as defined in claim 14, wherein said door is a sliding door.

16. A cremation container as defined in claim 14, wherein said door includes a latch for securing said door in a closed position.

17. A cremation container as defined in claim 12, further comprising mounting structure for mounting said container to a pole opposite said roof mounting structure.

18. A cremation container as defined in claim 12, further comprising a sealable container disposed in said inner chamber for storing said cremation ashes therein.

19. A method of converting a cremation container into a birdhouse comprising the steps of:

attaching a roof structure to a top surface of the cremation container to cover an inner chamber of the cremation container used to at least temporarily store cremation ashes; the top surface of the cremation container having an opening defined therein; and removing a closure from the cremation container to provide an entrance for a bird into the inner chamber of the cremation container.

20. A method as defined in claim 19, further comprising the step of scattering cremation ashes from said inner chamber of said cremation chamber prior to attaching said roof structure to said cremation container.

21. A method as defined in claim 19, further comprising the step of placing a sealable container for storing said cremation ashes therein in said inner chamber of the cremation container.

22. A combination cremation container and birdhouse comprising:

an outer structure having at least one side wall, an open on top, and cooperating inner chamber, said side wall having at least one portal for permitting entry of a bird into said inner chamber; and a sealable container disposed in said inner chamber for storing cremation ashes therein.

23. A combination cremation container and birdhouse as defined in claim 22, wherein said outer structure includes a surface having biographical information inscribed thereon.

24. A combination cremation container and birdhouse as defined in claim 22, wherein said outer structure includes a bottom surface opposite said roof, said bottom surface including mounting structure for mounting said structure to a pole.

25. A method of memorializing a deceased who has been cremated comprising the steps of:

storing the deceased's cremation ashes in a container at least temporarily;

converting said container into a birdfeeder; and by filling an inner chamber of said container with birdseed, said inner chamber of said container being adapted to at least temporarily store the cremation ashes therein;

displaying said birdfeeder in a manner wherein the deceased will be remembered upon viewing said birdfeeder.

26. A method as defined in claim 25, further comprising the step of inscribing biographical information concerning the deceased on said container.

27. A method as defined in claim 25, further comprising the step of scattering the deceased's cremation ashes from said container prior to converting said container into said birdfeeder.

28. A method as defined in claim 25, wherein the step of converting said container into a birdfeeder further comprises the step of:

attaching a food tray to a bottom surface of said container below an opening of said container, said opening being in communication with said inner chamber to permit the birdseed to fall out of said opening onto said food tray.

29. A method as defined in claim 25, wherein the step of converting said container into a birdfeeder further comprises the step of:

attaching a perch structure adjacent an opening of said container, said opening being in communication with said inner chamber to permit the birdseed to be accessible through said opening.

* * * * *

UNITED STATES PATENT AND TRADEMARK OFFICE

CERTIFICATE OF CORRECTION

PATENT NO. : 7,272,874 B2
APPLICATION NO. : 11/050132
DATED : September 25, 2007
INVENTOR(S) : Jeffrey Staab It is certified that error appears in the above-identified patent and that said Letters Patent is hereby corrected as shown below:

IN THE SPECIFICATION:

Column 1, Line 13 Now reads: "Up on the death of a loved one,"

Should read: --Upon the death of a loved one,--

IN THE CLAIMS:

Claim 22 at Column 8, Lines 50-51 Now reads: "an outer structure having at least one side wall, an open on top,"

Should read: --an outer structure having at least one side wall, an open top,--

Signed and Sealed this

Sixth Day of May, 2008

JON W. DUDAS
*Director of the United States Patent and Trademark Office*